US011007569B2

(12) United States Patent
Buerger et al.

(10) Patent No.: US 11,007,569 B2
(45) Date of Patent: May 18, 2021

(54) METHOD FOR TILT CASTING AND TILT CASTING DEVICE

(71) Applicant: KSM Castings Group GmbH, Hildesheim (DE)

(72) Inventors: Florian Buerger, Ilsede (DE); Viktor Boeshans, Giesen (DE); Roland Golz, Wernigerode (DE); Heik Lachmund, Holle (DE); Christian Richard, Harsum (DE); Philipp Kassner, Braunschweig (DE)

(73) Assignee: KSM Castings Group GmbH, Hildesheim (DE)

( * ) Notice: Subject to any disclaimer, the term of this patent is extended or adjusted under 35 U.S.C. 154(b) by 0 days.

(21) Appl. No.: 16/608,980

(22) PCT Filed: May 14, 2018

(86) PCT No.: PCT/DE2018/100455
§ 371 (c)(1),
(2) Date: Oct. 28, 2019

(87) PCT Pub. No.: WO2018/215020
PCT Pub. Date: Nov. 29, 2018

(65) Prior Publication Data

US 2020/0188992 A1 Jun. 18, 2020

(30) Foreign Application Priority Data

May 24, 2017 (DE) ..... 10 2017 111 437.8

(51) Int. Cl.
*B22D 23/00* (2006.01)
*B22D 35/04* (2006.01)
(Continued)

(52) U.S. Cl.
CPC ..... *B22D 23/006* (2013.01); *B22D 35/04* (2013.01); *B22D 39/026* (2013.01); *B22D 41/06* (2013.01)

(58) Field of Classification Search
CPC .... B22D 23/006; B22D 35/04; B22D 39/026; B22D 41/06
See application file for complete search history.

(56) References Cited

U.S. PATENT DOCUMENTS

2011/0114280 A1 5/2011 Iwasa et al.
2015/0239042 A1* 8/2015 Morikawa ..... B22D 18/04 164/284

FOREIGN PATENT DOCUMENTS

DE 10 2004 015 649 B3 8/2005
DE 10 2006 058 142 B4 9/2016
WO WO-2010068113 A1 * 6/2010 ..... F27D 3/14

OTHER PUBLICATIONS

English translation of the International Preliminary Report on Patentability and Written Opinion of the International Searching Authority in PCT/DE2018/100455, dated Dec. 5, 2019.
(Continued)

*Primary Examiner* — Kevin E Yoon
(74) *Attorney, Agent, or Firm* — Collard & Roe, P.C.

(57) ABSTRACT

A method for the tilt casting of a component from light metal, in particular of an aluminum alloy, uses a tilt casting mold having a mold cavity. The melt is continuously poured directly into the casting run of the tilt casting mold, which forms the sprue of the component, at the beginning of and during the tilting movement of the tilt casting mold, using a casting ladle or a casting scoop, and flows through the casting run into the mold cavity of the tilt casting mold from the beginning, wherein the casting ladle or the casting scoop continuously tracks the casting mold during the tilting movement.

4 Claims, 2 Drawing Sheets

Figure 1:
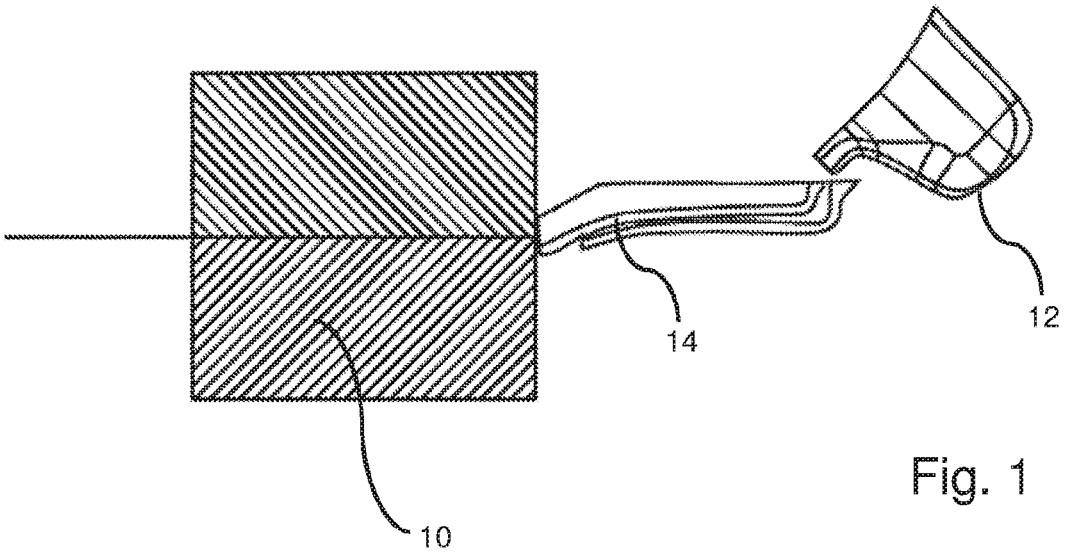

(51) Int. Cl.
*B22D 39/02* (2006.01)
*B22D 41/06* (2006.01)

(56) References Cited

OTHER PUBLICATIONS

Gießereilexikon [Casting Lexicon], 16th edition, 1994, p. 244 and p. 655, (Relevance discussed in Specification).
International Search Report in PCT/DE2018/100455, dated Jul. 27, 2018.

* cited by examiner

METHOD FOR TILT CASTING AND TILT CASTING DEVICE

CROSS REFERENCE TO RELATED APPLICATIONS

This application is the National Stage of PCT/DE2018/100455 filed on May 14, 2018, which claims priority under 35 U.S.C. § 119 of German Application No. 10 2017 111 437.8 filed on May 24, 2017, the disclosure of which is incorporated by reference. The international application under PCT article 21(2) was not published in English.

The invention relates to a method for tilt casting of a component composed of light metal, in particular of an aluminum alloy, by means of a tilt casting mold having a mold cavity, which has no core or at least one core, as well as to a tilt casting device for carrying out the method.

Different casting methods for the production of components composed of light metal, as well as corresponding casting devices that are suitable for carrying out such methods are known from the state of the art.

DE 10 2006 058 142 B4 discloses a method for tilt casting of components composed of light metal, as well as a corresponding casting device. Methods and devices for tilt casting of components composed of light metal are known—as described in DE 10 2006 058 142 B4. In the case of the tilt casting method, which is described in general form in the standard work "Gießereilexikon [Casting Lexicon]," 16$^{th}$ edition, 1994, p. 244 and p. 655, a die or casting mold is rotated about a tilt axis by up to 90°, while the melt flows into the die. By means of this measure, the die can be filled with the metal melt in particularly advantageous manner, without flow turbulences. A significant advantage of tilt casting, which is frequently mentioned in the literature, consists in that any splashed metal that might occur during gravity die casting can be prevented by guiding the metal melt along a wall of the casting mold.

A method for casting components composed of light metal, in particular of aluminum alloys, according to the tilt casting principle, is known from DE 10 2004 015 649 B3, which is listed as prior art in DE 10 2006 058 142 B4, as is a corresponding device for carrying out such a method. In the case of this method, the melt if filled into a transverse run situated on the longitudinal side of a casting mold. In this regard, the casting mold is first tilted about its longitudinal axis by an angle of 45° to 70°. After, filling the liquid melt into the transverse run begins, until about ⅕ of the melt required for casting of the component has been filled into the transverse run, without the melt already flowing into the mold cavity of the casting mold. Subsequently, the casting mold is rotated to the perpendicular position from the tilted position, while the melt is still continuously filled in, in such a manner that the melt flows into the mold cavity along a wall of the casting mold.

Proceeding from this prior art, the invention is based on the task of improving a method for tilt casting of a component composed of light metal by means of a tilt casting mold having a mold cavity, as well as improving a tilt casting device for carrying out the method.

This task is accomplished by means of a method having the characteristics of claim 1, as well as by a tilt casting device for carrying out the method, having the characteristics of claim 6. Further developments and advantageous embodiments can become evident from the dependent claims.

The method according to the invention, for tilt casting of a component composed of light metal, by means of a tilt casting mold having a mold cavity, provides that the light-metal melt is continuously poured directly into the casting run of the tilt casting mold, which forms the sprue of the component, at the beginning of and during the tilting movement of the tilt casting mold, using a casting ladle or a casting scoop, and flows through the casting run into the mold cavity of the tilt casting mold from the beginning, wherein the casting scoop or the casting ladle continuously tracks the casting mold during the tilting movement.

In this connection, continuously means that the melt is poured into the casting run without interruption at the beginning of and during the tilting movement of the tilt casting mold, and that during this process, the casting scoop or the casting ladle constantly tracks the tilt casting mold during the tilting movement. However, continuous feed of the melt or continuous tracking of the casting scoop or the casting ladle can also end before the end of the tilting movement of the tilt casting mold, under some circumstances, for example if sufficient melt for forming the component is already contained in the tilt casting mold or in the casting run connected with the mold cavity, during or toward the end of the tilting movement of the tilt casting mold. Since the melt is poured into the casting run without interruption up to such a point in time, and the casting scoop or the casting ladle constantly tracks until such a point in time, here, too, continuous pouring of the melt and continuous tracking of the casting scoop or the casting ladle during the tilting movement of the casting mold takes place.

According to the invention, no casting pools, no melt collection container, for example in the form of a transverse run, or the like are provided, into which the melt is filled from a casting ladle or a casting scoop, at least in part, before and during the tilting movement of the tilt casting mold.

It can be advantageous to provide a screening device, a foam filter or the like, preferably composed of ceramic, in particular in order to retain an oxide skin situated on the melt. The screening device, the foam filter or the like can advantageously be disposed on the casting ladle or on the casting scoop.

In fact, it is advantageous if the melt is filled directly into the transverse run directly from the casting ladle or casting scoop, specifically both at the beginning of the tilting movement, when the tilt casting mold and thereby the casting run are in a pouring position referred to as a starting position in the present case, and during the tilting movement, wherein the melt flows into the mold cavity of the tilt casting mold directly through the casting run. It has been shown that in the case of this method according to the invention, high-quality components composed of light metal can be produced. Although actually a turbulent flow would be expected as a result of directly pouring the melt out of the casting ladle or casting scoop into the casting run, it does not occur in this manner, but rather it appears to weaken in the casting run, in any case, if it occurs at all. The circumstance that the tilt casting method differs from the gravity casting method, in which the melt more or less falls into the mold cavity, contributes to this.

It can be advantageous if the tilt casting mold is brought into a starting position, referred to as a pouring position according to the invention, at the beginning of the tilting movement, in which position the melt flows into the mold cavity of the tilt casting mold free of turbulence, to the greatest possible extent, when it is poured into the casting run. This is preferably a position in which the casting run opens into the mold cavity in relatively flat manner. According to the invention, this starting position is referred to as a pouring position, because the melt introduced into the casting run by means of the casting ladle or casting scoop already flows into the mold cavity in the starting position, even if no tilting movement of the tilt casting mold has been performed yet or if it is just starting. In other words, no casting pool or melt collection container or the like is provided, in which melt collects before the tilting movement of the tilt casting mold.

It can be advantageous if the tilt casting mold is tilted about a tilting axis by up to 90°.

It can be advantageous if the casting scoop or the casting ladle is guided at a distance from the casting run, in other words is not connected with the mold. In this manner, the casting scoop or the casting ladle can be guided independently of the tilt casting mold that has a casting run.

It can be advantageous if the melt required for casting of the component is made available in the casting scoop or the casting ladle.

It can be advantageous if the melt is guided through a bottleneck within the casting run. Such a bottleneck can have an advantageous effect on possible undesirable flow turbulences.

The invention furthermore relates to a tilt casting device for carrying out the method according to one of claims 1 to 6, comprising a tilt casting mold that has a mold cavity, into which cavity the melt can be poured by way of a casting run, and means for tilting the tilt casting mold from a pouring position into a position tilted by up to 90° relative to the former, wherein the casting device does not have a casting pool or melt holding container, for example in the form of a transverse run, in particular does not have a casting pool or melt holding container that stands in a flow connection with the casting run, for example in the form of a transverse run.

Because of the fact that no casting pool, no melt collection container, for example in the form of a transverse run, or the like is provided, into which the melt is filled, according to the state of the art, from a casting ladle or a casting scoop, at least in part, before the tilting movement of the tilt casting mold, the result is achieved that the melt advantageously makes a transition directly from the casting ladle or the casting scoop directly into the casting run, specifically both at the beginning of the tilting movement, when the tilt casting mold and therefore the casting run are situated in a starting position referred to as a pouring position in the present case, and during the tilting movement, wherein the melt flows into the mold cavity of the tilt casting mold directly through the casting run. Although a turbulent flow would actually be expected as the result of direct pouring of the melt out of the casting ladle or the casting scoop into the casting run, it does not occur in this manner.

In order to weaken any turbulent flow that does occur, it can be advantageous if a bottleneck is provided within the casting run.

It can be advantageous if the casting device has a casting ladle or a casting scoop assigned to it, wherein the melt can be poured into the casting run of the tilt casting mold that forms the sprue of the component, by means of the casting ladle or the casting scoop, at the beginning of and during the tilting movement of the tilt casting mold, continuously and directly.

Figure 2:
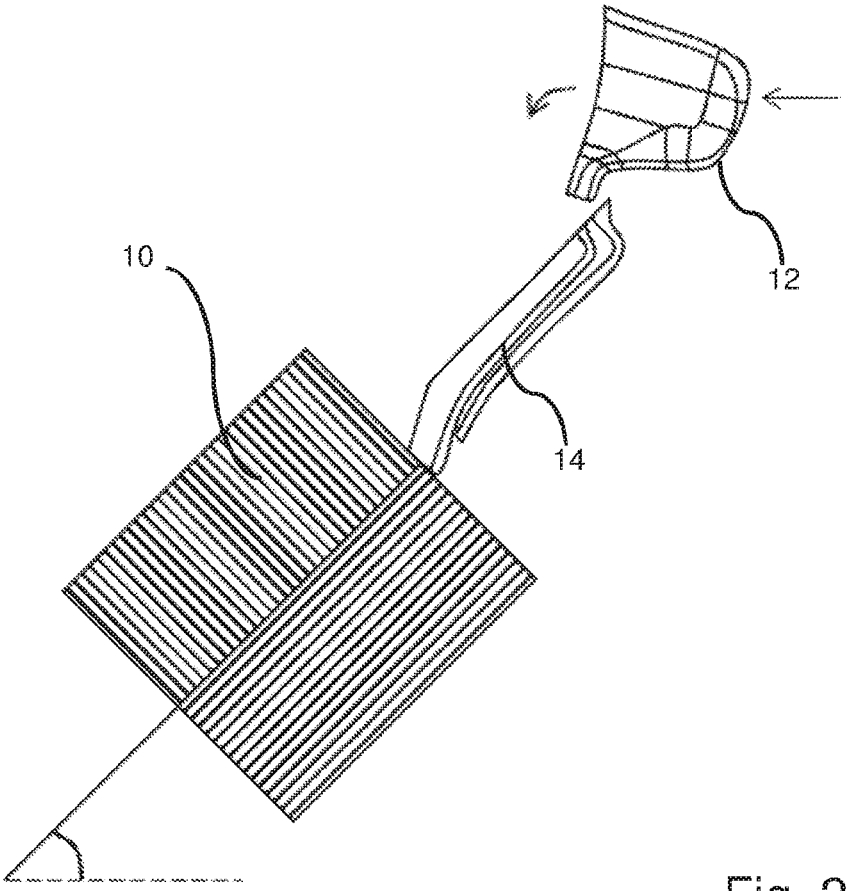
Figure 3:
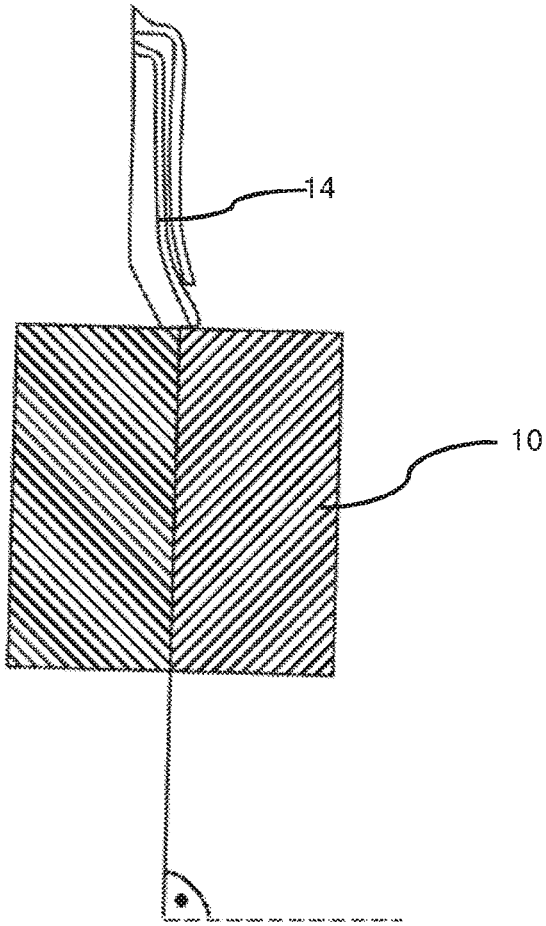

In the following, the invention will be explained using an exemplary embodiment, which is shown in the drawing. In the drawing, the figures show:

FIG. 1 schematically, a snapshot of casting scoop and casting mold with casting run at the beginning of the tilting movement of the casting mold with casting run, FIG. 2 schematically, a snapshot of casting scoop and casting mold with casting run during the tilting movement of the casting mold with casting run, and FIG. 3 schematically, a snapshot of the casting mold with casting run at the end of the tilting movement of the casting mold with casting run.

In the drawing, characteristics that are significant for understanding the invention are shown and explained. If the same reference numbers are used in the figures, these refer to the same parts.

In the case of the method according to the invention for tilt casting of a component composed of light metal, in particular of an aluminum alloy, by means of a tilt casting mold 10 having a mold cavity, the melt is continuously poured, at the beginning of and during the tilting movement of the tilt casting mold 10, into the casting run 14 of the tilt casting mold 10, which forms the sprue of the component, directly, using a casting scoop 12, wherein the melt flows into the mold cavity of the tilt casting mold 10 through the casting run 14 from the beginning, and the casting scoop 12 continuously tracks the tilt casting mold 10 during the tilting movement.

As shown in FIG. 1, the tilt casting mold 10 is brought into a pouring position at the beginning of the tilting movement, in which position the melt flows into the mold cavity of the tilt casting mold 10 with low turbulence, to the greatest possible extent, while it is being poured into the casting run 14. The tilt casting mold 10 is then tilted about a tilting axis by 90°.

In this regard, FIG. 2 shows a snapshot of the tilt casting mold 10 tilted by 45, while FIG. 3 shows the end position, preferably the solidification position of the tilt casting mold 10, tilted by 90°.

In this regard, the casting scoop 12 is guided at a distance from the casting run 14, in other words not connected with the mold.

The invention claimed is:

1. A method for tilt casting of a component composed of light metal by means of a tilt casting mold having a mold cavity, wherein the melt is continuously poured directly into a casting run of the tilt casting mold, which forms a sprue of the component, only while the tilt casting mold is in a tilted position at the beginning of and during the tilting movement of the tilt casting mold, using a casting ladle or a casting scoop, and flows through the casting run into the mold cavity of the tilt casting mold from the beginning, wherein the casting ladle or the casting scoop continuously tracks the casting mold during the tilting movement, wherein the casting ladle or the casting scoop is guided at a distance from the casting run.

2. The method for tilt casting according to claim 1, wherein the tilt casting mold is brought into a pouring position at the beginning of the tilting movement, in which position the melt flows into the mold cavity of the tilt casting mold free of turbulence, when it is poured into the casting run.

3. The method for tilt casting according to claim 1, wherein the tilt casting mold is tilted about a tilting axis by up to 90°.

4. The method for tilt casting according to claim 1, wherein the melt is guided through a bottleneck within the casting run.

* * * * *